US007558513B2

(12) United States Patent
Sugimoto et al.

(10) Patent No.: US 7,558,513 B2
(45) Date of Patent: Jul. 7, 2009

(54) DEVELOPING DEVICE AND IMAGE FORMING APPARATUS

(75) Inventors: Hiroko Sugimoto, Osaka (JP); Hirohisa Endou, Osaka (JP); Yukihiro Mori, Osaka (JP)

(73) Assignee: Kyocera Mita Corporation (JP)

( * ) Notice: Subject to any disclaimer, the term of this patent is extended or adjusted under 35 U.S.C. 154(b) by 415 days.

(21) Appl. No.: 11/602,076

(22) Filed: Nov. 20, 2006

(65) Prior Publication Data

US 2007/0122203 A1 May 31, 2007

(30) Foreign Application Priority Data

Nov. 28, 2005 (JP) ..... 2005-342382

(51) Int. Cl.
*G03G 15/08* (2006.01)
*G03G 21/00* (2006.01)

(52) U.S. Cl. ..... 399/254; 399/256; 399/258; 399/359

(58) Field of Classification Search ..... 399/265, 399/256, 254, 255, 263, 359, 258
See application file for complete search history.

(56) References Cited

U.S. PATENT DOCUMENTS

| | | | | |
|---|---|---|---|---|
| 4,723,143 | A * | 2/1988 | Enomoto | 399/254 |
| 5,355,199 | A * | 10/1994 | Bray | 399/256 |
| 5,659,859 | A * | 8/1997 | Kikuta et al. | 399/256 |
| 6,249,664 | B1 * | 6/2001 | Sato | 399/256 |
| 7,024,151 | B2 * | 4/2006 | Katoh et al. | 399/359 |
| 7,039,344 | B2 * | 5/2006 | Nishiyama | 399/254 |
| 7,333,755 | B2 * | 2/2008 | Koido | 399/254 |
| 2003/0156859 | A1 * | 8/2003 | Tamai | 399/254 |
| 2005/0111883 | A1 * | 5/2005 | Amano et al. | 399/254 |

FOREIGN PATENT DOCUMENTS

| | | | |
|---|---|---|---|
| JP | 59100472 | A * | 6/1984 |
| JP | 05-249828 | | 9/1993 |
| JP | 08-054809 | | 2/1996 |
| JP | 09-197786 | | 7/1997 |
| JP | 2000-029312 | | 1/2000 |
| JP | 2001-235933 | | 8/2001 |

* cited by examiner

*Primary Examiner*—Susan S Lee
(74) *Attorney, Agent, or Firm*—Gerald E. Hespos; Anthony J. Casella

(57) ABSTRACT

A housing of a developing device has a circulating conveyance passage with a front conveyance passage along a developing roller and a rear conveyance passage parallel to the front conveyance passage. Front and rear spiral feeders are provided in the front and rear conveyance passages for conveying developer particles. The housing has a first developer inlet opening for receiving developer particles from a developer supplier and a second developer inlet opening for receiving recycled developer particles. The rear spiral feeder includes a conveyance power reduction portion at a position downstream from the first and second developer inlet openings and locally reduces conveyance power. The first and second developer inlet openings upstream of the conveyance power reduction portion and are where developer particles are likely to be upwardly surged due to the rotation of the rear conveyer.

12 Claims, 6 Drawing Sheets

DEVELOPING DEVICE AND IMAGE FORMING APPARATUS

BACKGROUND OF THE INVENTION

1. Field of the Invention

The invention relates to a copying machine and a facsimile machine, various kinds of image forming apparatuses such as a printer and a developing device applied to the image forming apparatuses. More particularly, it relates to a developing device and an image forming apparatus including a mechanism for resupplying recycled toner particles.

2. Description of the Related Art

As a developing device applied to image forming apparatuses such as a copying machine and a facsimile machine, a developing device disclosed in a Japanese Unexamined Patent Publication No. 2001-235933 is known. The developing device includes a housing for supplying toner particles to a photoconductive drum of an image forming apparatus, and a toner cartridge detachably mounted on the housing for supplying toner particles. In a bottom portion of the toner cartridge, an openable and closable toner discharging section is formed. In the housing, a toner inlet section corresponding to the toner discharging section is formed. When the toner discharging section is opened by mounting the toner cartridge on the housing, toner particles stored in the toner cartridge is supplied to a predetermined circulating conveyance passage provided in the housing.

The circulating conveyance passage is formed to be a groove extending parallel in an axial direction of the photoconductive drum and having an open end in its upper portion. The circulating conveyance passage has a front conveyance passage extending along a developing roller, and a rear conveyance passage extending parallel to the front conveyance passage and passing a position to receive developer particles from the developer inlet section. In each of the conveyance passages, a spiral feeder having a spiral fin spirally formed on a periphery of the feeder shaft is provided. Toner particles (toner particles and carrier particles in the case of two-component developer particles) are circulated in the front conveyance passage and the rear conveyance passage in accordance with a rotation of the spiral fin about the feeder shaft.

Toner particles received by the rear conveyance passage from the toner cartridge through the toner inlet section are moved to the front conveyance passage by a rotation of the spiral feeder about the feeder shaft and then sent to the front conveyance passage through a communicating passage at a downstream of the rear conveyance passage. Toner particles moved to the front conveyance passage are supplied to a peripheral surface of the developing roller while being conveyed in accordance with a driving of the spiral feeder in a direction opposite to the conveyance direction of the rear conveyance passage. Remainder of toner particles are conveyed back to the rear conveyance passage at a downstream end of the front conveyance passage. In the case of using two-component developer particles, toner particles and carrier particles are stirred and mixed in the rear conveyance passage. Then, a required amount of developer particles (toner particles and carrier particles) are supplied to the peripheral surface of the developing roller in the front conveyance passage. Remainder of developer particles are conveyed back to the rear conveyance passage.

In a developing device of the Japanese Unexamined Patent Publication No. 2001-235933 having such fundamental construction, a conveyance power reduction portion which is so constructed as to reduce a conveyance power locally is provided at a location which is on downstream of the toner inlet section in a conveyance direction of the spiral feeder provided in the rear conveyance passage. The conveyance power reduction portion is provided for causing retaining of toner particles on upstream thereof. Since the retaining of toner particles occurs between the conveyance power reduction portion and the toner inlet section, retained toner particles block the toner inlet section to thereby restrict supply of toner particles when enough amount of toner particles exist in the developing device. On the contrary, when toner particles in the developing device are consumed and amount of toner particles is reduced, the retained toner particles are also reduced. Accordingly, a space is formed between the portion where toner particles are retained and the toner inlet section so that toner particles fall down from the toner cartridge and supplied into the developing device. When enough amount of toner particles are supplied into the developing device, retaining of toner particles occurs and the toner inlet section is closed so that the supply of toner particles is restricted. As can be seen, the amount of toner particles supplied to the developing device from the toner cartridge is automatically adjusted in accordance with amount of toner particles existing in the developing device.

Meanwhile, there is a known mechanism aimed for reusing toner particles by recovering toner particles resided on a photoconductive drum after a transferring process and resupplying the same to the developing device as recycled toner particles (for example, refer to Japanese Unexamined Patent Publication Nos. 2001-235933, 2000-29312, HEI8-54809, HEI9-197786 and HEI5-249828). Adopting such mechanism provides an advantage that toner particles resided after the transferring process can be utilized effectively.

However, since the conveyance power reduction portion described above is provided so as to retain toner particles and restrict supply of toner particles from the toner cartridge in the developing device described in Japanese Unexamined Patent Publication No. 2001-235933, a problem of clogging (a phenomenon where toner particles are rammed down and clog a toner inlet section so that toner particles are not supplied from the toner cartridge even though toner particles run short) has been arose when the developing device is, for example, in a high-temperature environment or in the condition where a low-darkness printing is executed for a long time so that few toner particles are consumed.

Especially in the case where toner particles resided on the photoconductive drum after a transferring process is recovered and supplied again to the developing device as recycled toner particles, there has been a problem that clogging is likely to occur since a fluidity of recycled toner particles is generally lowered. Further, since recycled toner particles have low charging characteristic, there has been a problem that toner particles are not well mixed (well attached with charges) with carrier particles. This is because recycled toner particles undergo various kinds of stresses before they are resupplied to the developing device and various changes such as separation and burial of agent particles and aggregation of toner particles so that fluidity and charging characteristic are changed from the initial state.

SUMMARY OF THE INVENTION

The invention present invention has worked out in view of the problems described above and is intended for a developing device including a conveyance power reduction portion. An object of the invention is to effectively prevent clogging occurred in a vicinity of a toner inlet section in the toner circulating passage of the developing device. More particularly, an object of the invention is to provide a developing device and an image forming apparatus capable of preventing the clogging and improving a charging characteristic of toner particles in the case where a mechanism for resupplying recycled toner particles to the developing device is provided.

To achieve the object, the developing device according to the invention has the following construction.

A developing device for supplying developer particles to a peripheral surface of an image bearing member comprises: a housing; a circulating passage for conveying developer particles while stirring them, the circulating passage being provided in the housing; a developer supplier for supplying developer particles in the housing; a developer inlet section for allowing developer particles to come in from the developer supplier, the developer inlet section being formed in an upper portion of the housing; a conveyance mechanism for conveying developer particles received through the developer inlet section, the conveyance mechanism being provided in the circulating passage; and a developing roller provided at a position of facing the image bearing member, wherein: the circulating passage includes a front conveyance passage extending along the developing roller, and a rear conveyance passage extending parallel to the front conveyance passage and passing a position to receive developer particles from the developer inlet section, the conveyance mechanism includes a front conveyer and a rear conveyer which are rotatable about their respective axes to convey developer particles in specified conveyance directions, the front conveyer being provided in the front conveyance passage and the rear conveyer being provided in the rear conveyance passage, the rear conveyer having a conveyance power reduction portion for reducing the conveyance power locally, and the developer inlet section includes a first developer inlet opening for allowing developer particles from the developer supplier to come in, and a second developer inlet opening for allowing developer particles recovered from the image bearing member to come in, the first and second developer inlet openings being provided in the circulating passage at locations which are on upstream of the conveyance power reduction portion of the rear conveyer and where developer particles coming from the first developer inlet opening and/or the second developer inlet opening are likely to be upwardly surged due to the rotation of the rear conveyer.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Figure 1:
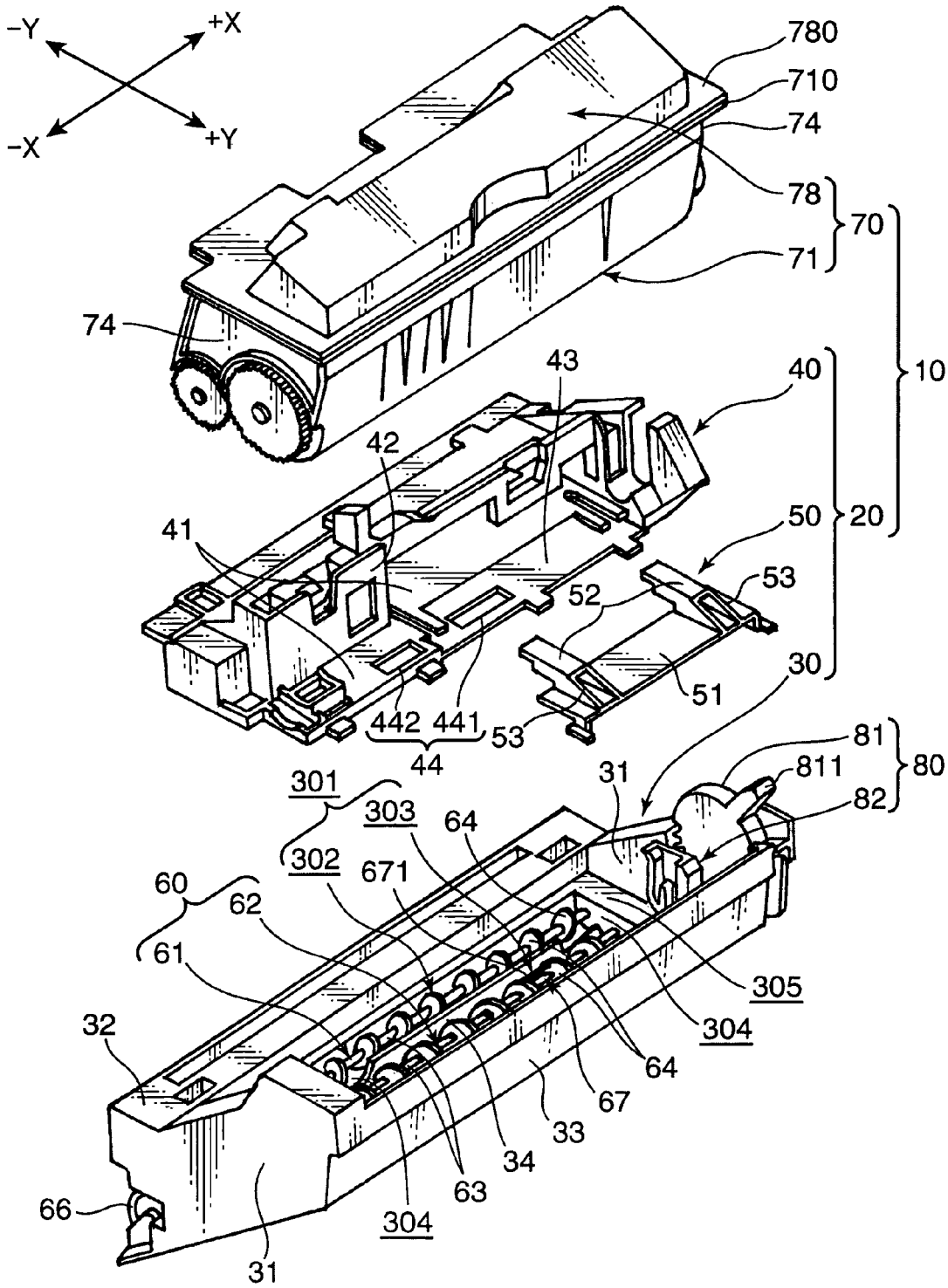
FIG. 1 is an exploded perspective view showing an embodiment of a developing device according to the invention.
Figure 2:
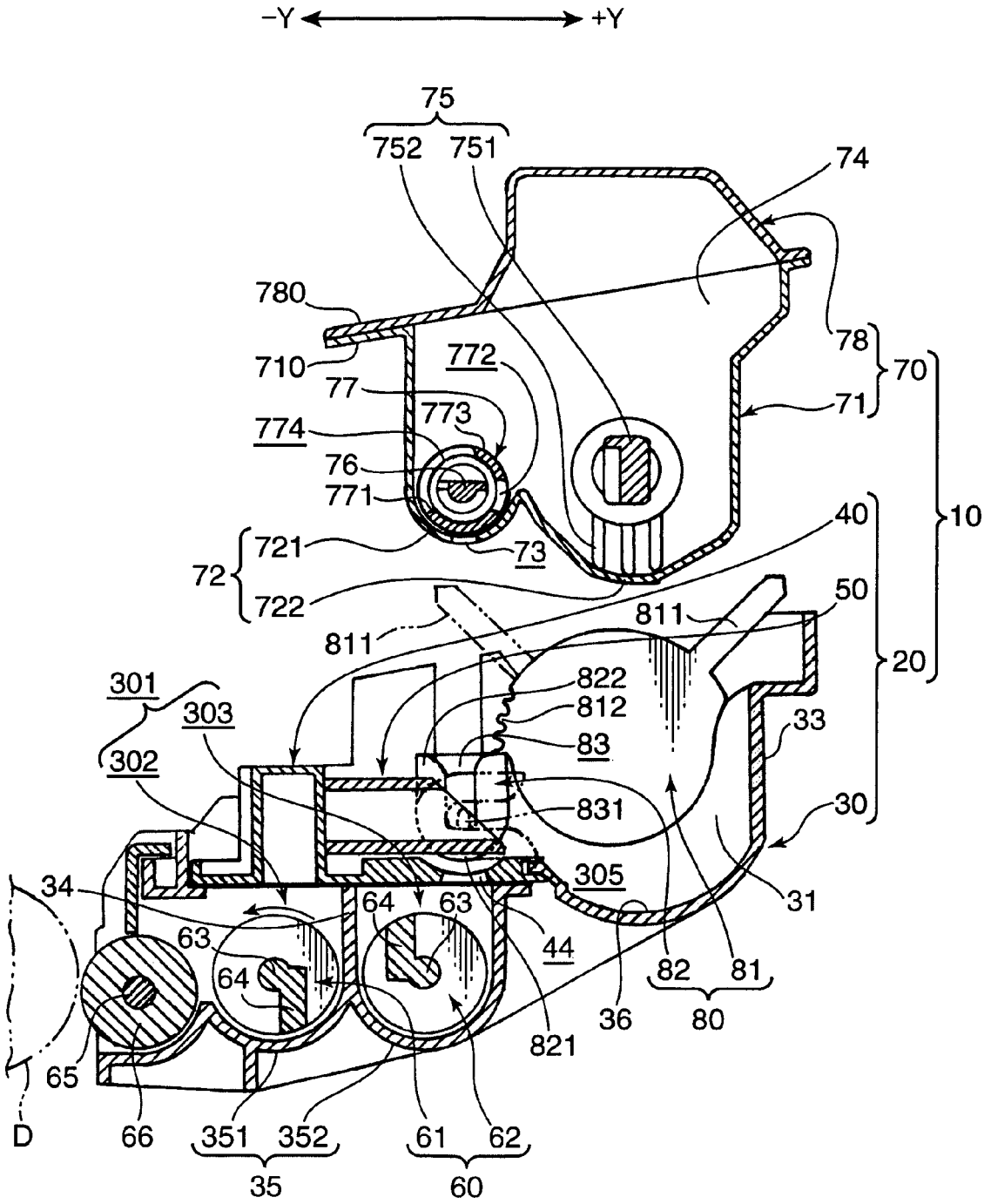
FIG. 2 is a sectional view of the developing device shown in FIG. 1 in a side view showing the state where a toner cartridge is detached from a housing of the developing device.
Figure 3:
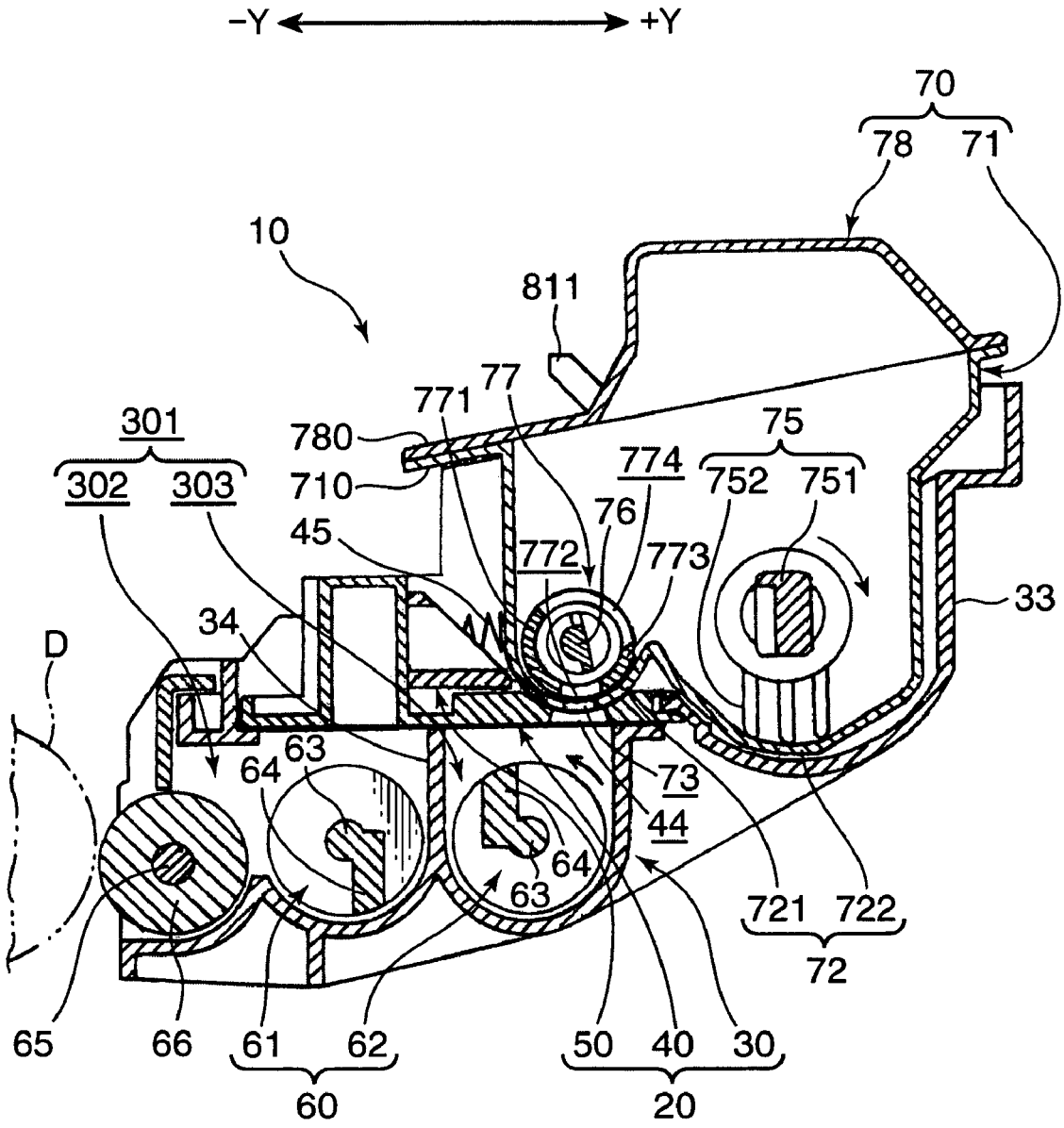
FIG. 3 is a sectional view of the developing device shown in FIG. 1 in a side view showing the state where a toner cartridge is mounted on the housing of the developing device.
Figure 4:
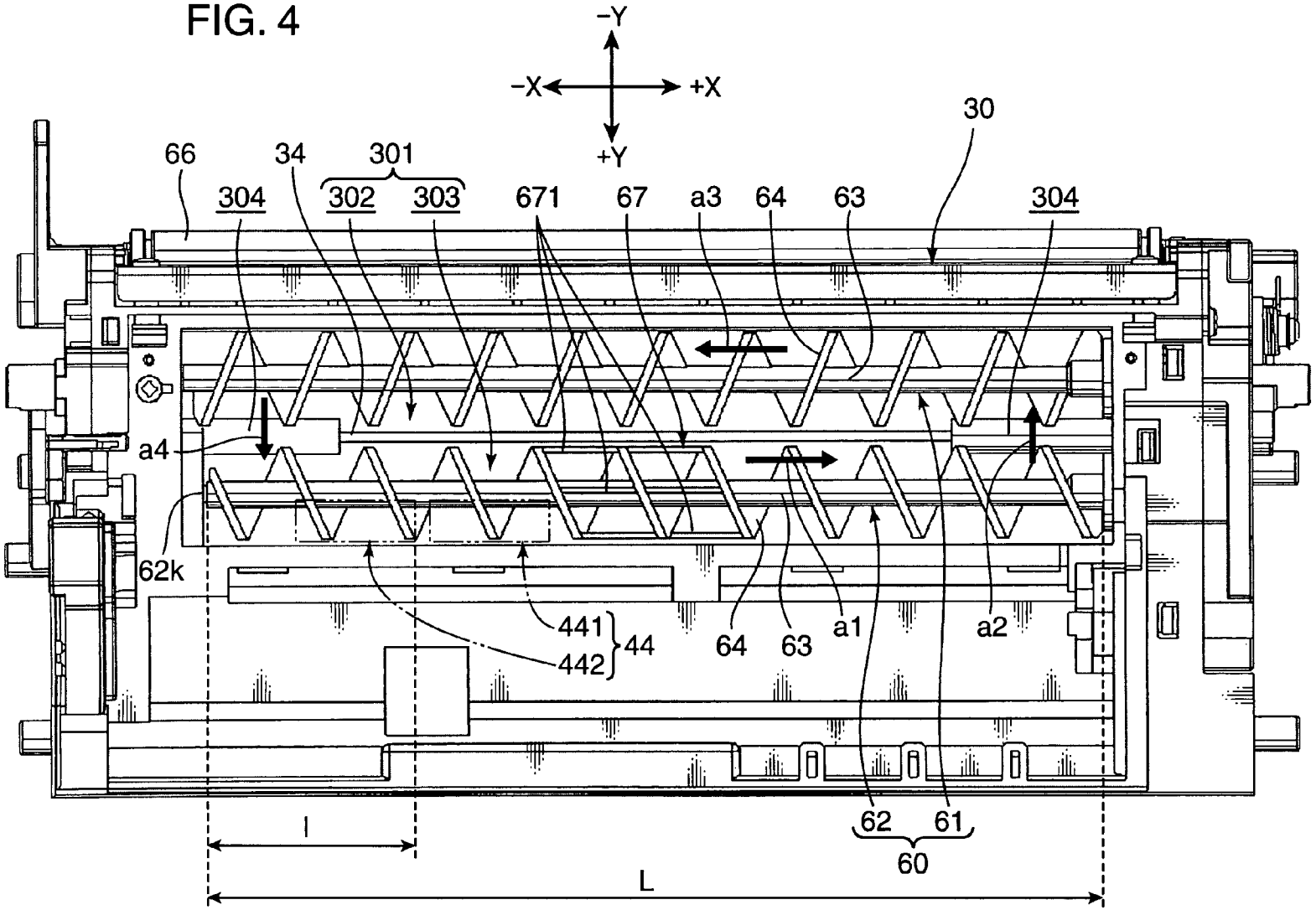
FIG. 4 is a sectional plan view of the housing of the developing device.

FIG. 1 is an exploded perspective view showing an embodiment of a developing device according to the invention. FIGS. 2 and 3 are sectional views of the developing device shown in FIG. 1 viewing from side. FIG. 2 shows the state where a toner cartridge is detached from a housing of the developing device, and FIG. 3 shows the state where the toner cartridge is mounted on the housing of the developing device. FIG. 4 is a sectional plan view of the housing of the developing device. In these figures, X-X directions denote width directions, and Y-Y directions denote forward and backward directions. Particularly, −X direction denotes a leftward direction, +X direction denotes a rightward direction, −Y direction denotes a forward direction and +Y direction denotes a backward direction.

As shown in FIG. 1, a developing device 10 has a fundamental structure including a main body 20 (a housing portion) and a toner cartridge 70 (developer supplier). The main body 20 is provided adjacent to a photoconductive drum (image bearing member) D (refer to FIGS. 2 and 3) for supplying developer particles to a peripheral surface of the photoconductive drum D. The toner cartridge 70 is detachably mounted on the main body 20 and is adapted for supplying toner particles in the main body 20. In the embodiment, two-component developer particles including carrier particles and toner particles are used as an example of the developer particles.

The main body 20 includes a housing 30, a cover body 40 and a cover body shutting member 50. The housing 30 has a circulating conveyance passage 301 (circulating passage) for circulating two-component developer particles in the main body 20. The cover body 40 is adapted for closing an opening formed in an upper portion of the housing 30. The cover body shutting member 50 is attached to the cover body 40 for opening and closing a first toner inlet opening 441 (first developer inlet opening) formed on the cover body 40. The main body 20 is formed by fixedly placing on the housing 30 the cover body 40 to which the cover shutter member 50 is attached.

The housing 30 includes a pair of side plates 31, a front plate 32, a rear plate 33 and a bottom plate 35. Each side plate 31 is formed to have a shape similar to a rhombus extending downwardly in a frontward direction and is provided in a widthwise part of the housing 30. The front plate 32 is provided extendingly between front ends of the respective side plates 31. The rear plate 33 is provided extendingly between rear ends of the side plates 31. The bottom plate 35 is provided extendingly in lower end parts of the side plates 31 and of the rear plates 33 (FIG. 2). In a space surrounded by the side plates 31, the front plate 32, the rear plate 33 and the bottom plate 35, a circulating conveyance passage 301 for circulatedly conveying developer particles. A pair of spiral feeders 60 are provided in the circulating conveyance passage 301. Further, a developing roller 66 is provided in front of the spiral feeders 60.

The circulating conveyance passage 301 includes a front conveyance passage 302 and a rear conveyance passage 303. The front conveyance passage 302 is formed in a front portion extendingly along the developing roller 66 and is long in a width direction. The rear conveyance passage 303 is formed behind the front conveyance passage 302 and is formed parallel to the front conveyance passage 302. The spiral feeder 60 includes a front spiral feeder 61 (front conveyance mechanism) and a rear spiral feeder 62 (rear conveyance mechanism). The front spiral feeder 61 is provided in the front conveyance passage 302. The rear spiral feeder 62 is provided in the rear conveyance passage 303. As shown in FIG. 2, a front conveyance passage bottom plate 351 and a rear conveyance passage bottom plate 352 are provided in the bottom plate 35 of the circulating conveyance passage 301. The front conveyance passage bottom plate 351 has an arc-shaped cross section corresponding to the front conveyance passage 302. The rear conveyance passage bottom plate 352 has an arc-shaped cross section corresponding to the rear conveyance passage 303. The front spiral feeder 61 and the rear spiral feeder 62 are rotationally driven by an unillustrated driving section such as a driving motor.

Each of the front spiral feeder 61 and the rear spiral feeder 62 has a feeder shaft 63 and a spiral fin 64. Each feeder shaft 63 is extendingly provided between the pair of side plates 31 in the circulating conveyance passage 301. The spiral fin 64 is spirally formed around the feeder shaft 63. The spiral feeders 61, 62 circulatedly convey developer particles supplied in the circulating conveyance passage 301 by an integral rotation of the spiral fin 64 around the feeder shaft 63.

In the embodiment, the spiral fin 64 of the front spiral feeder 61 has a counter-clockwise spiral moving forward by a rotation in a counter-clockwise direction viewed from an end of the feeder shaft 63. On the other hand, the spiral fin 64 of the rear spiral feeder 62 has a clockwise spiral moving forward by a rotation in a clockwise direction viewing from an end of the feeder shaft 63. Thus, when the front spiral feeder 61 is rotated in a counter-clockwise direction about the feeder shaft 63, developer particles positioned in the front conveyance passage 302 are moved in a leftward direction (a direction indicated by an arrow a3 in FIG. 4). On the other hand, when the rear spiral feeder 62 is rotated in a counter-clockwise direction about the feeder shaft 63, developer particles in the rear conveyance passage 303 are conveyed in a rightward direction (a direction indicated by an arrow a1 in FIG. 4).

Further, a partition wall 34 is provided between the front conveyance passage 302 and the rear conveyance passage 303 so as to divide the conveyance passages 302, 303. Further, the partition wall 34 has notches each formed in a left end portion and right end portion thereof providing communication passages 304, 304 bypassing opposite ends of the front conveyance passage 302 and the rear conveyance passage 303. Accordingly, a circulating passage for circulating developer particles passing through the front conveyance passage 302, the rear conveyance passage 303 and communication passages 304, 304 can be formed. Herein, when the front spiral feeder 61 and the rear spiral feeder 62 are rotated respectively about the feeder shaft 63 in a counter-clockwise direction, the developer particles in the circulating conveyance passage 301 are circulatedly conveyed in a counter clockwise direction between the front conveyance passage 302 and the rear conveyance passage 303 through the communication passages 304, 304 as indicated by arrows a1 through a4 in FIG. 4.

As shown in FIGS. 2 and 3, a roller shaft 65 is provided extendingly between the pair of side plates 31 at a front position of the front conveyance passage 302. Further, a developing roller 66 is axially supported integrally rotatably about the roller shaft 65. Further, portions where the front conveyance passage 302 and the developing roller 66 are provided is formed to be communicable to each other in almost entire length in a width direction, and a position of the developing roller 66 is set at a position of facing the peripheral surface of the photoconductive drum D located in front. Thus, toner particles included in developer particles to be conveyed in the front conveyance passage 302 are supplied to the peripheral surface of the photoconductive drum D through the developing roller 66. Accordingly, a toner image is formed on the peripheral surface of the photoconductive drum D.

The cover body 40 includes a plate-like cover main body 41 and a standing wall 42. The standing wall 42 is positioned at a central position in forward and backward directions of the main body 41 and extends in a width direction. The cover main body 41 has a size set to be slightly larger than an opening formed in an upper portion of the housing 30. Accordingly, an upper portion of the circulating conveyance passage 301 is closed in the state where the cover main body 41 is covered on the upper face of the housing 30. In almost widthwisely central part of the cover main body 41 at a backward position from the standing wall 42, a shutter attaching position 43 for attaching the cover body shutting member 50 is provided.

In the cover main body 41, a toner inlet section 44 for filling the housing 30 with toner particles is provided. The toner inlet section 44 includes a first toner inlet opening 441 (first developer inlet opening) for allowing toner particles from the toner cartridge 70 to come into the housing 30 and a second toner inlet opening 442 (second developer inlet opening) for allowing recycled toner particles recovered from the photoconductive drum D to come into the housing 30. The first toner inlet opening 441 and the second toner inlet opening 442 are serially arranged on the circulating conveyance passage 301 (rear conveyance passage 303) and are provided at locations which are on upstream of a conveyance power reduction portion 67 of the rear spiral feeder 62 described herein after in the circulating passage. Further, the first toner inlet opening 441 is provided in the shutter placing portion 43, and the cover body shutter member 50 is provided for opening and closing the toner inlet opening 441.

The toner inlet section 44 (the first toner inlet opening 441 and the second toner inlet opening 442) is provided at a position where toner particles coming through the first toner inlet section 44 to the housing 30 are likely to be upwardly surged due to a rotation of the rear spiral feeder 62. In other words, as shown in FIGS. 2 and 3, the toner inlet section 44 is provided at a position of facing an upstream of the rotational direction of the rear spiral feeder 62 in the state where the cover body 40 is placed on the housing 30. In the embodiment, the rear spiral feeder 62 is configured to be rotated in a counter clockwise direction about the feeder shaft 63. Accordingly, the toner inlet section 44 is provided at an upstream of the rotational direction. That is to say, with regard to a rotational direction of the rear spiral feeder 62 in a cross section perpendicular to the feeder shaft 63, in the case where an upstream of the rotational direction indicates a rotational part which comes close to the toner inlet section 44 within a rotation about the feeder shaft 63 and a downstream of the rotational direction indicates a rotational part which moves away from the toner inlet section 44, the toner inlet section 44 is provided so as to face the upstream of the rotational direction of the rear spiral feeder 62.

Thus, toner particles supplied into the rear conveyance passage 303 through the toner inlet section 44 are guided by a rotation of spiral fin 64 of the rear spiral feeder 62 and moved in an upper part of the spiral fin 64 from the rear part to the front part. Thereafter, toner particles are led by the rotation of the spiral fin 64 in the counter-clockwise direction about the feeder shaft 63 and conveyed in a rightward direction (backside of sheets of FIGS. 2 and 3). At this time, toner particles are stirred and mixed with carrier particles existing in the rear conveyance passage 303. It will be described hereinafter, but it should be noted that such manner of supplying toner particles suppresses clogging of toner particles.

Next, a preferable location of the toner inlet section 44 on the circulating conveyance passage 301 (rear conveyance passage 303) is described. In the invention, the toner inlet section 44 may be positioned at an upstream of the conveyance power reduction portion 67 of the rear spiral feeder 62 in the circulating conveyance passage 301 . However, since the recycled toner particles which generally have lower charging characteristic and fluidity are resupplied, it is preferable to send out the recycled toner particles after providing enough charging characteristic thereto. Accordingly, it is preferable that at least the second toner inlet opening 442 for resupplying recycled toner particles is provided at as much upstream of the rear conveyance passage 303 as possible so that recycled toner particles to be resupplied and carrier particles are well stirred and mixed in the spiral feeder 62.

Particularly, as shown in FIG. 4, it is preferable that the second toner inlet opening 442 is provided in a location which satisfies the following equation (1) where l denotes a distance between an upstream end 62*k* of the rear spiral feeder 62 and a downstream end of the second toner inlet opening 442, and L denotes a length of the rear spiral feeder 62.

$$\leqq 2/5 \times L \quad (1)$$

Especially, it is preferable to satisfy the following equation (2).

$$l \leqq 1/3 \times L \quad (2)$$

Setting a position of the second toner inlet opening 442 as described above conserves enough time for stirring and mixing recycled toner particles to be resupplied. A frictional charging occurred between recycled toner particles and carrier particles during that time serves enough electrostatic adherence therebetween. Consequently, recycled toner particles can be mixed appropriately with carrier particles.

Such effect becomes apparent if toner particles having an average particle size of 4.0 to 7.5 μm are used and toner-blended agent having more than 2.0 wt % or particularly more than 3.0 wt % of total amount of agent particles are used. Namely, since lowering of fluidity and increase in adherence becomes apparent as particle size of toner particles becomes smaller, some means such as increasing fluidity by increasing amount of agent or lowering adherence by adding large-diameter agent are taken. However, in the case where the fluidity is secured by adding large amount of agent, recycled toner particles are likely to be separated from the agent particles. Accordingly, lowering of the fluidity becomes especially apparent. Further, in the case where a large-diameter agent is used, burial of toner particles occurs, and effect of such phenomenon becomes more apparent when recycled toner particles are used. If the invention is applied in the case where such mixture of toner particles is used and recycled toner particles are re-supplied into the main body 20 of the developing device, especially the fluidity and charging characteristic of recycled toner particles can be improved.

It is preferable that the second toner inlet opening 442 (or first toner inlet opening 441) is formed on as much upstream in the rear conveyance passage 303 as possible. However, it is preferable that a portion of the communication passage 304 and the second toner inlet opening 442 does not completely overlap with each other. In the communication passage 304, developer particles are conveyed in a direction indicated by the arrow a4 from the front conveyance passage 302. On the other hand, a flow of the developer particles is so complicated due to a rotational driving force the rear spiral feeder 62. Accordingly, supplied recycled toner particles (new toner particles) are not well mixed with carrier particles. For example, in the case where a rotational direction of the rear spiral feeder 62 is the same as that of the direction indicated by arrow a4 from upper view, great amount of developer particles are pressingly compressed toward a side wall of the developing device 20 facing the communication passage 304. Accordingly, supplied toner particles are susceptible to be retained therein. Further, also in the case where the rotational direction of the rear spiral feeder 62 is reversed with respect to the direction indicated by the arrow a4, movement of toner particles toward the direction which the toner particles are conveyed is balanced out by developer particles conveyed from the communication passage 304 toward the direction indicated by the arrow a4. Accordingly, a flow of toner particles is disturbed, and toner particles are likely to be retained therein. Consequently, it is preferable that the second toner inlet opening 442 (or the first toner inlet opening 441) is positioned on a slightly downstream of the conveyance direction from the communication passage 304.

However, it is preferable that the second toner inlet opening 442 (or the first toner inlet opening 441) is not completely separated from the communication passage 304 but is placed close to the communication passage 304 to some extent. A flow of developer particles becomes more stable if the second toner inlet opening 442 is placed away toward the downstream and roughness in surfaces (upper surface of a particle flow layer) of developer particles is calm. However, if the flow of developer particles is stable, electrostatic adherence by a frictional charging with carrier particles is not likely to occur since recycled toner particles has low charging characteristic and fluidity. Accordingly, toner particles become less susceptible to be mixed with carrier particles. On the contrary, surface (upper surface of the particle flow layer) of developer particles is rough in proximity of the communication passage 304. Accordingly, it can be expected that recycled toner particles are mingled with carrier particles and likely to be mixed therein.

In the embodiment, the second toner inlet opening 442 for supplying recycled toner particles is positioned on an upstream in a conveyance direction from the first toner inlet section 441 for supplying new toner particles. Positioning the inlet openings in such a manner reserves time long enough for stirring and mixing recycled toner particles having low charging characteristics and fluidity. Of course, the first toner inlet opening 441 may be formed on an upstream in a conveyance direction from the second toner inlet opening 442. Further, it should be noted that the first toner inlet opening 441 does not necessarily have to be formed at a position satisfying the equations (1) and (2) described above. However, it is preferable that the first inlet opening 441 at a position satisfying the equations (1) and (2) described above to reserve enough time for stirring and mixing new toner particles supplied from the first toner inlet opening 441, resided developer particles and recycled toner particles.

The cover body shutting member 50 includes a shutter plate 51 and a pair of projections 52. The shutter plate 51 corresponds to the first toner inlet opening 441. The pair of projections 52 are provided in opposite widthwise ends of the shutter plate 51 and extend in forward and backward directions thereof. The shutter plate 51 has a enough size for closing up the first toner inlet opening 441. Further, at each rear end of the pair of projections 52, a sloped surface 53 having an end sloping downward in a backward direction is provided. These sloped surfaces 53 are adapted for moving the cover shutter member 50 when the toner cartridge 70 is mounted on the main body 20 of the developing device and comes in contact with the bottom portion of the toner cartridge 70. The shutter plate 51 moves forward by the sloped surfaces 53 so that the first toner inlet opening 441 becomes open.

As shown in FIG. 3, in the state where the toner cartridge 70 is mounted on the main body 20 of the developing device, the toner cartridge 70 is pressed backward by a coil spring 45 which is a biasing member. Accordingly, the mounting state of the toner cartridge 70 against the main body 20 of the developing device becomes stable.

The cover body shutting member 50 is urged to move backward by an unillustrated biasing member such as a coil spring. Thus, in the state where the toner cartridge 70 is not mounted on the main body 20 of developing device, the first toner inlet opening 441 falls in the state of being closed by the shutter plate 51. On the other hand, when the toner cartridge 70 is mounted on the main body 20 of the developing device, the sloped surface 53 of the cover shutter member 50 is pressed by a lower portion of the toner cartridge 70 so as to move forward while resisting against the biasing force generated by the biasing member. Accordingly, the first toner inlet opening 441 becomes open.

As shown in FIG. 1, the toner cartridge 70 includes a cartridge main body 71 for storing toner particles and a cover body 78 for closing an upper opening of the cartridge main body 71. At an upper end portion of the cartridge main body 71, an annular main body flange portion 710 projecting outward is provided. On the other hand, the cover body 78 has a cover flange portion 780 corresponding to the main body flange portion 710. In the state where the toner cartridge 70 is filled with toner particles, the flange portions 710, 780 are fixed with each other by an adhesion process and the like. Consequently, the toner cartridge 70 filled with toner particles therein is finalized.

The cartridge main body 71 has a leftward and rightward width set to be slightly smaller than the distance between the pair of side plates in the housing of the main body 20 of the developing device. A forward and backward size of the cartridge main body 71 is set to be slightly smaller than an inner size between the rear plate 33 of the housing 30 and the standing wall 42 of the cover body 40. Accordingly, the toner cartridge 70 is placed on upper part of the circulating conveyance passage 301 of the housing 30 and is detachably placed on the cartridge mounting space 305 surrounded by the side plates 31, the rear plate 33 and the standing wall 42.

As shown in FIG. 2, the cartridge main body 71 is formed to have the bottom plate 72 having two bumps in a side view. Namely, the bottom plate 72 has a front arc-shaped bottom plate 721 corresponding to the shutter placing portion 43 of the cover body 40 and a rear arc-shaped bottom plate 72 formed on a backward position of the front arc-shaped bottom plate 721.

In the bottommost position of the front arc-shaped bottom plate 721, a toner discharging opening 73 is formed at a position of facing the toner inlet section 44 (first toner inlet opening 441) of the cover body 40. In the state where the toner cartridge 70 is mounted on the housing 30 (FIG. 3), toner particles stored in the toner cartridge 70 are supplied to the housing 30 through the toner discharging portion 73 and the toner inlet section 44 of the cover body 40.

In an upper portion of the rear arc-shaped bottom plate 722, a stirring member 75 is extendingly provided between the pair of side plates 74 along a curvature center position of the rear arc-shaped bottom plate 722. The stirring member 75 includes a shaft member 751 and a stirring fin 752. The shaft member 751 extends between the pair of side plates 74 rotatably about its axis center. The stirring fin 752 projects from a peripheral surface of the shaft member 751 in a radial direction. The stirring fin 752 is formed of a sheet body made of synthetic resin, and the stirring member 75 is rotated by driving of an unillustrated driving motor in a clockwise direction in FIG. 3 about the axis center. Accordingly, toner particles on the rear arc-shaped bottom plate 722 are scraped off and supplied to the front arc-shaped bottom plate 721.

In an upper portion of the front arc-shaped bottom plate 721, a spiral rod 76 extendingly provided between the pair of side plates 74 along a curvature center position of the front arc-shaped bottom plate 721 and a cartridge side shutter member 77 exteriorly placed on the spiral rod 76. A setting of direction and a rotational direction of the spiral rod 76 is set so that the spiral rod 76 is integrally rotated with the stirring member 75 to thereby convey toner particles sent from the rear arc-shaped bottom plate 722 to the front arc-shaped bottom plate 721 toward the toner discharging portion 73.

The cartridge shutter member 77 is formed of a cylindrical body rotatably placed on the spiral rod 76 and includes an arc-shaped shutter portion 771, a elongate hole 772 and an arc-shaped wall 773. The arc-shaped shutter portion 771 is adapted for closing the toner discharging portion 73. The elongate hole 772 has a length which is long in a width direction (a direction perpendicular to a sheet of FIG. 2) and corresponds to the toner discharging portion 73 provided adjacent to a counter-clockwise end portion of the arc-shaped shutter portion 771. The arc-shaped wall 773 is provided adjacent to the elongate hole 772 in a counter-clockwise direction. Between end portions of the arc-shaped shutter portion 771 and the arc-shaped wall 773 facing each other in a peripheral direction, an opening 774 for supplying toner particles sent by the stirring member 75 to the spiral rod 76.

The cartridge shutter member 77 is shiftable to a toner discharging portion closing posture shown in FIG. 2 and to a toner discharging portion opening posture shown in FIG. 3. Further, the side plate 31 on a right side of the housing 30 is provided with a posture shifting operation member 80 for shifting a posture of the cartridge shutter member 77.

As shown in FIG. 2, the posture shifting operation member 80 has an operational circular plate 81 and a posture shifting member 82. The operational circular plate 81 is mounted on outer side of the side plate 31 rotatably about the approximate curvature center of the arc-shaped bottom plate 36 in the cartridge mounting space 305. The posture shifting member 82 is linked with a rotation of the operational circular plate 81 and shifts the cartridge side shutter member 77 between the toner discharging portion closing posture and the toner discharging portion opening posture. The operational circular plate 81 is provided with an operational lever projecting outwardly in a radial direction of its peripheral surface and engaging teeth 812 on a peripheral surface facing the operational lever 811.

The posture shifting member 82 consists of a semi-circular portion 821 and a rectangular portion 822. The semi-circular portion 821 is a semi-circular shaped portion formed in a lower portion of the posture shifting member 82. The rectangular portion 822 is a rectangular-shaped portion formed integrally in an upper portion of the semi-circular portion 821. The posture shifting member 82 is mounted in an inner side of the right-hand side plate 31 of the housing 30 and is supported axially and rotatably about an unillustrated shaft so as to have a common curvature center position with that of the semi-circular portion 821.

In an inner side of the posture shifting member 82, a fitting groove 83 is formed. The fitting groove 83 is formed convexly toward a curvature center position of the semi-circular portion 821 from an end portion of the rectangular portion 822 at a position of facing the semi-circular portion 821. A right-hand end portion of the spiral rod 76 is fitted into the fitting groove 83. At the curvature center position of the fitting groove 83, an engaging projection 831 projecting outwardly from a curvature center is formed. On the other hand, at a right-hand end portion of the cartridge shutter member 77, an unillustrated engaging groove exteriorly placed on the engaging protrusion 831 is provided.

Further, in the state where the operational lever 811 is reclined backward as indicated by a solid line in FIG. 2, the toner cartridge 70 in the state where the cartridge side shutter member 77 is set in the toner discharging portion closing posture is mounted in the cartridge mounting space 305 of the housing 30. Accordingly, the engaging groove is exteriorly placed on the engaging projection 831.

If the operational lever 811 is operated to rotate the operational circular plate 81 in a counter clockwise direction in this state (refer to the operational lever 811 shown in FIG. 2 by a two-dotted chain line), the rotation is transmitted to the posture shifting member 82 through the engaging teeth 812. Then, the posture shifting member 82 is rotated in a clockwise direction about the curvature center and shifted to a lying posture as indicated by a two-dotted chain line as in FIG. 2. In accordance with the rotation of the cartridge side shutter member 77 in a clockwise direction through the engaging projection 831, the cartridge side shutter member 77 is shifted to the toner discharging portion opening posture where the elongate hole 772 faces the toner discharging opening 73.

Figure 5:
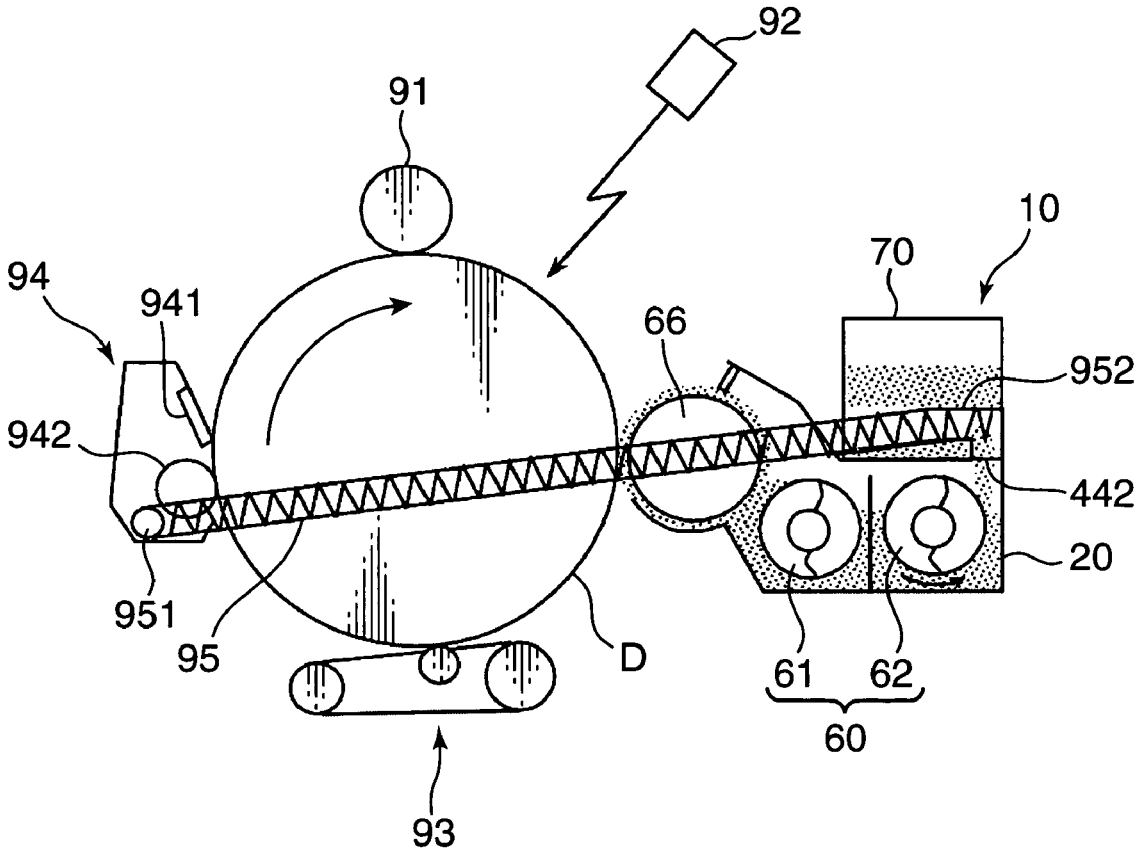
FIG. 5 is a sectional view showing a system of supplying recycled toner particles.

The main body 20 of the developing device according to the embodiment also has a system for supplying recycled toner particles in addition to a system for supplying toner particles from the toner cartridge 70 (new toner particles). FIG. 5 is a sectional view showing the system for supplying recycled toner particles and shows a schematic view of an image forming portion around the photoconductive drum D. The image forming portion includes the photoconductive drum D, a charging roller 91, an exposing device 92, the above-described developing device 10, a transferring section 93 and a cleaning section 94. The photoconductive drum D is an image bearing member consists of, for example, amorphous silicon and is so constructed as to be rotatable in a direction indicated by an arrow in FIG. 5.

The charging roller 91 is adapted for uniformly charging a surface of the photoconductive drum D at a predetermined electric potential. The exposing device 92 is constructed by a laser scanning unit and the like and is adapted for irradiating a laser beam (LED light ray) to the surface of the photoconductive drum D to form an electrostatic latent image on the photoconductive drum D. The laser beam is formed based on an image data transmitted from an unillustrated image data storing section and the like. The developing device 10 makes toner particles attached to an electrostatic latent image formed on the photoconductive drum D to expose an electrostatic latent image as a toner image. The transferring section 93 transfers toner image on the photoconductive drum D to a recording sheet (unillustrated). The cleaning section 94 is adapted for cleaning toner particles resided on the surface of the photoconductive drum D after a toner transfer by the transferring section 93 is completed. The cleaning section 94 includes a cleaning blade 941 and a cleaning roller 942. The cleaning blade 941 is adapted for scraping off resided toner particles from the surface of photoconductive drum D.

In such construction, a toner conveyance duct 95 is provided extendingly between the cleaning section 94 and the developing device main body 20. In the toner conveyance duct 95, a powder conveyance member such as a spiral feeder is interiorly provided so that powder can be conveyed from one end 951 to the other end 952. The end 951 of the toner conveyance duct 95 is open in the cleaning section 94, and the other end 952 is connected to the second toner inlet opening 442 formed in the main body 20. Thus, when the powder conveyance section is driven, toner particles recovered from the cleaning section 94 (recycled toner particles) are conveyed toward the main body 20 and supplied to the circulating conveyance passage 301 through the second toner inlet opening 442.

Figure 6:
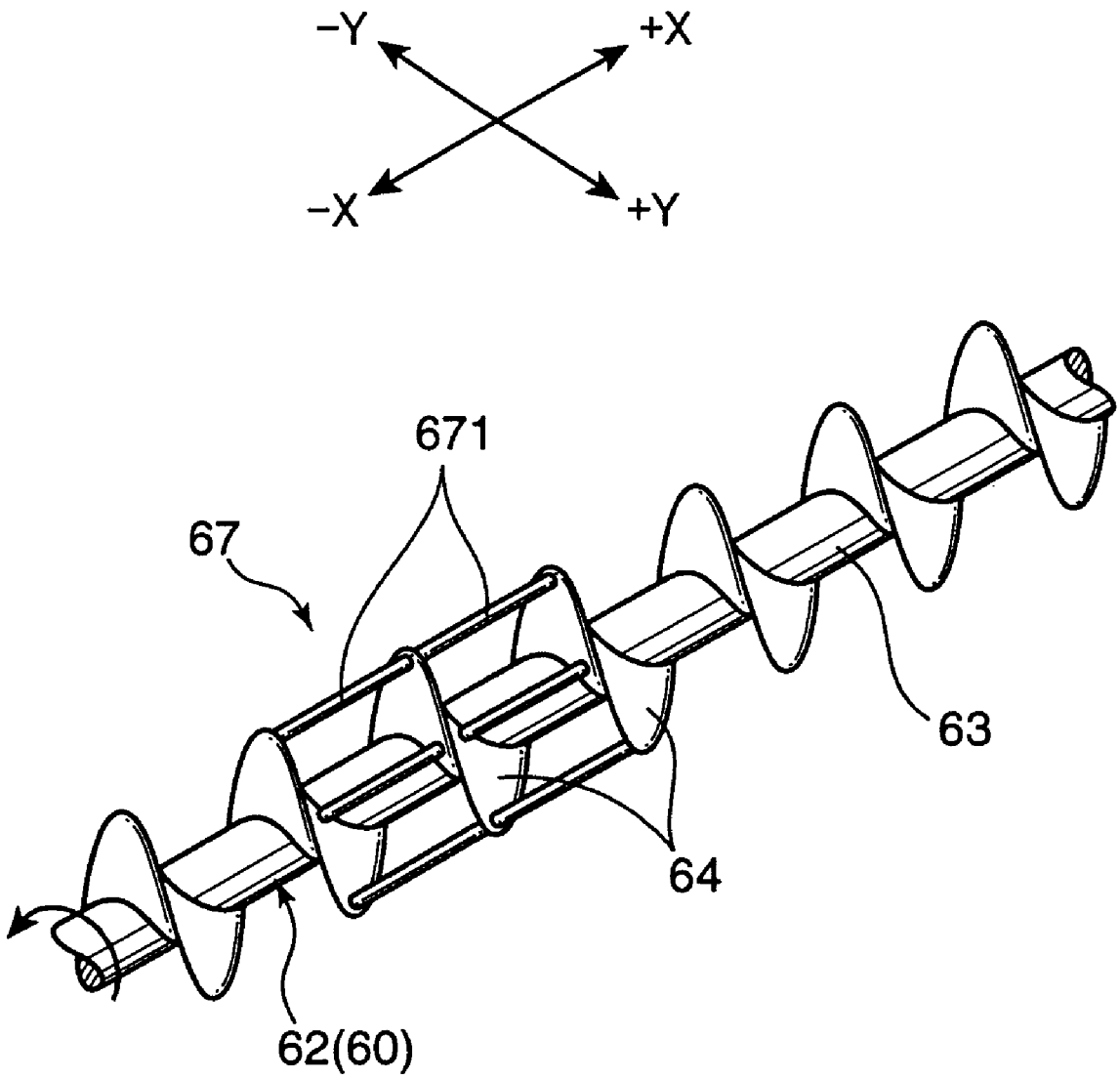
FIG. 6 is a perspective view showing an embodiment of a conveyance power reduction portion.

In addition to the above construction, in the main body 20 of the developing device according to the embodiment, as shown in FIG. 4, the rear spiral feeder 62 is provided with the conveyance power reduction portion 67 at a downstream of the toner inlet section 44 in a conveyance direction. FIG. 6 is a perspective view showing an embodiment of the conveyance power reduction portion 67. As shown in FIG. 6, the conveyance power reduction portion 67 includes multiples of reduction rods (rib member) 671 which are provided in a peripheral rim of the spiral fin 64 parallel to the feeder shaft 63 in a peripheral direction. In the embodiment, four reduction rods 671 are provided in an even pitch in a peripheral direction. However, number of reduction rods 671 is not limited to four but can be less or more than four.

Since such conveyance power reduction portion 67 is provided on the rear spiral feeder 67 at a downstream of the toner inlet section 44, developer particles conveyed to a downstream by the spiral fin 64 rotated by a counter-clockwise rotation of the feeder shaft 63 about the axis center are disturbed by the reduction rod 671 at the time when they reach the conveyance power reduction portion 67 and become difficult to move forward. Accordingly, the developer particles are retained at an upstream of the conveyance power reduction portion 67. Thus, when toner particles are supplied and amount of developer particles increases, retained developer particles close up the toner inlet section 44 to thereby suppress further supply of toner particles. When toner particles are consumed and amount of accumulated developer particles decreases, a gap is formed between a part where developer particles are retained and the toner inlet section 44, and toner particles are supplied to the gap.

Hereinafter, operation of the developing device 10 is described. New toner particles are supplied to the main body 20 of the developing device from the toner cartridge 70 through the toner inlet opening 441, or, recycled toner particles collected in the cleaning section 94 are supplied into the developing device main body 20 through the second toner inlet opening 442. The first toner inlet opening 441 and the second toner inlet opening 442 are provided above the circulating conveyance passage 301 (rear conveyance passage 303) and upstream in a conveyance direction from the conveyance power reduction portion 67 provided in the rear spiral feeder 62. Accordingly, by the above-described retaining of toner particles, new toner particles and recycled toner particles are appropriately supplied in accordance with consumption of toner particles.

Supplied toner particles are stirred and mixed with developer particles (carrier) existing in the main body 20 by the rear spiral feeder 62 and conveyed to a downstream of the rear conveyance passage 303 (a direction indicated by an arrow a1 in FIG. 4). Then, the developer particles reach the front conveyance passage 302 through the communication passage 304 as indicated by the arrow a2. While the developer particles are conveyed by the front spiral feeder 61 in a direction indicated by the arrow a3, a required amount of developer particles are sent out to the developing roller 66. Thereafter, developer particles including resided toner particles are sent back to an upstream end of the rear conveyance passage 303 through the communication passage 304 as indicated by an arrow a4.

Further, as shown in FIG. 3, in the developing device 10, toner inlet section 44 is provided so as to face an upstream of a rotational direction of the spiral feeder 62 in the case where a rotational portion of a rotation in a cross-section perpendicular to the feeder shaft 63 of the rear spiral feeder 62 of the feeder shaft 63 coming close to the toner inlet section 44 (the first toner inlet opening 441 and the second toner inlet opening 442) is determined as an upstream of a rotational direction and a rotating portion moving away from the toner inlet section 44 is determined as a downstream of the rotational direction. Accordingly, new toner particles supplied from the first toner inlet opening 441 and recycled toner particles supplied from the second toner inlet opening 442 are likely to be upwardly surged by the spiral fin 64 of the rear spiral feeder 62.

Thus, even if the conveyance of toner particles (developer particles) becomes likely to be retained by conveyance power reduction portion 67 of the rear spiral feeder 62, a movement of developer particles becomes very active due to an upward surging in a vicinity of the toner inlet section 44. Further, since toner particles are conveyed in an axial direction through an upstream wall (rear plate 33), shelf-lifting is not likely to be occurred. Further, since recycled toner particles having less fluidity and charging characteristic may be sufficiently stirred and mixed with the existing developer particles (carrier), an appropriate charging characteristic can be provided. According to these operations, toner particles can be constantly and stably supplied into the main body 20 of the developing device. Further, darkness of toner particles can be stabilized at the time of image forming.

For comparison, in the case where the toner inlet section 44 is formed at a downstream of a rotational direction of the rear spiral feeder 62 (prior art), there is less movement of retained developer particles. Accordingly, developer particles are rammed down. Therefore, in the case where recycled toner particles having less fluidity is resupplied into the developing device main body 20 or in the case where toner particles are in a high-temperature environment where a fluidity of toner particle gets worse and a low darkness printing consuming far less toner particles is performed for a long time, the clogging becomes like to be occurred.

The present invention is not limited to the above-described embodiment but can take embodiments (1) through (3) as described herebelow.

(1) In the above-described embodiment, the spiral fin 64 having a counterclockwise spiral direction is applied as the front spiral feeder 61, and, on the other hand, the spiral fin 64 having a clockwise spiral direction is adapted as the rear spiral feeder 62. Accordingly, by rotating the front and rear spiral feeders 61, 62 in the same direction, toner particles are circulatedly conveyed along the circulating conveyance passage 301. In place of this, the spiral fins 64 of the front and rear spiral feeders 61, 62 may have the same spiral direction and be rotated in directions reverse to each other. With such construction, toner particles can be circulatedly conveyed in the circulating conveyance passage 301.

(2) In the above-described embodiment, the toner inlet section 44 is provided at a downstream of the rear conveyance passage 303 since the rotational direction of the rear spiral feeder 62 is a counter-clockwise direction in FIG. 3. However, the invention is not limited to provide the toner inlet section at a rear part of the rear conveyance passage 303. In the case where the rotational direction of the rear spiral feeder 62 is a clockwise direction, the toner inlet section 44 may be provided in a front side of the rear conveyance passage 303. With such construction, the toner inlet section 44 may be provided in an upstream of the rotational direction of the rear spiral feeder 62.

(3) In the embodiment, the conveyance power reduction portion 67 is formed by providing the reduction rod 671 parallel to the feeder shaft 63 at a peripheral end portion of the spiral fin 64. However, the present invention is not limited to form the conveyance power reduction portion 67 by providing the reduction rod 671 on the spiral fin 64 but may adapt various methods as long as it obstructs conveyance of the toner particles. For example, a method of making a radial size of the spiral fin 64 smaller at the part corresponding to the conveyance power reduction portion 67 may be adapted.

Further, the above-described embodiment includes the invention having the following constructions.

The developing device according to one aspect of the invention comprises: a housing for supplying developer particles to a peripheral surface of an image bearing member while stirring the developer particles and conveying the same in the circulating passage; and a developer supplier for supplying developer particles in the housing. The housing includes: a developer inlet section provided in an upper part of the housing; a conveyance mechanism for conveying developer particles received through the developer inlet section, the conveyance mechanism being provided in the circulating passage; and a developing roller provided at a position of facing the image bearing member. The circulating passage includes a front conveyance passage extending along the developing roller, and a rear conveyance passage extending parallel to the front conveyance passage and passing a position to receive developer particles from the developer inlet section. The conveyance mechanism includes a front conveyer and a rear conveyer which are rotatable about their respective axes to convey developer particles in specified conveyance directions. The front conveyer is provided in the rear conveyance passage, and the rear conveyer is provided in the rear conveyance passage. The rear conveyer has a conveyance power reduction portion for reducing the conveyance power locally. The developer inlet section includes: a first developer inlet opening for allowing developer particles from the developer supplier to come in; and a second developer inlet opening for allowing developer particles recovered from the image bearing member to come in. The first and second developer inlet openings are provided in the circulating passage at locations which are on upstream of the conveyance power reduction portion of the rear conveyer. Further, the developer inlet openings are provided at locations where developer particles coming from the first developer opening and the second developer opening are likely to be upwardly surged due to the rotation of the rear conveyer.

Further, an image forming apparatus according to another aspect of the invention comprises: a developing device including a conveyance mechanism for conveying developer particles; and a driving mechanism for driving the conveyance mechanism. The developing device has the construction described above.

According to this construction, both developer particles came into the housing of the developing device from the first developer inlet opening of housing of the developing device from developer supplier and recycled developer particles recovered from the image bearing member came into the housing of the developing device through the second developer inlet opening are upwardly surged by the rotation of the rear conveyer and constantly conveyed in an axial direction at an immediately under the first and second developer inlet openings. Accordingly, the disadvantage of clogging does not occur. Further, the first and the second developer inlet openings are provided in the circulating passage at locations which are on upstream of the conveyance power reduction portion of the rear conveyer so that developer particles and recycled developer particles are once accumulated in the conveyance passage. Accordingly, in the case where two-component developer is used, a time for frictionally charging toners and carriers can be conserved. Consequently, a charging characteristic of toner particles can be improved.

According to such developing device or image forming apparatus, the clogging does not occur even in the case where recycled developer particles are resupplied into the developing device. Further, the charging characteristic can be improved. Thus, toner particles can be constantly and stably supplied into the developing device, and darkness of toner particles can be stabilized at the time of image forming.

In the above-described construction, it is preferable that the second developer inlet opening is provided in a location which satisfies the equation $l \leqq \frac{2}{5} \times L$ where l denotes a distance between an upstream end of the rear conveyer in a conveyance direction and a downstream end of the second developer inlet opening, and L denotes a length of the rear conveyer.

According to this construction, recycled developer particles come into the casing at a position near to upstream of the conveyance direction of the rear conveyer. Accordingly, in the case where two-component developer particles are used, relatively long time for conveying recycled developer particles (recycled toner particles) having less charging characteristic can be conserved. Accordingly, the charging characteristic can be improved. Further, even if the fluidity of recycled toner particles is lowered, recycled developer particles can be well mixed with respect to carrier particles since the time for stirring by the rear conveyer becomes relatively long. Thus, even in the case of using recycled toner particles, toner particles can be supplied constantly and stably with respect to the developing roller.

Further, in the above-described construction, it is preferable that the second developer inlet opening is provided on upstream of the first developer inlet opening in the circulating passage. According to this construction, recycled developer particles having lower charging characteristic is supplied from a position upstream from the position where new developer particles supplied from the developer supplier. Accordingly, charging characteristic of the recycled developer particles is further improved. Thus, better image forming can be performed stably.

In any one of the above-described constructions, it is preferable that the developer particles are a two-component developer including carrier and toner. According to this construction, occurrence of clogging of the developer particles is suppressed. Accordingly, charging characteristic of toner particles including recycled toner particles can be made better.

In the above-described construction, it is preferable that each of the front conveyer and the rear conveyer includes a spiral feeder having a feeder shaft and a spiral fin spirally formed on a periphery of the feeder shaft for conveying developer particles in a predetermined conveyance direction in accordance with an integral rotation of the spiral fin and the feeder shaft. According to this construction, a conveyance mechanism having a simple and inexpensive construction including a feeder shaft and a spiral fin can be established.

In this case, the spiral fin of the rear conveyer has a clockwise spiral direction.

This application is based on patent application No. 2005-342382 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device for supplying developer particles to a peripheral surface of an image bearing member comprising:

a housing;

a circulating passage for conveying developer particles while stirring them, the circulating passage being provided in the housing;

a developer supplier for supplying developer particles in the housing;

a developer inlet section for allowing developer particles to come in from the developer supplier, the developer inlet section being formed in an upper portion of the housing;

a conveyance mechanism for conveying developer particles received through the developer inlet section, the conveyance mechanism being provided in the circulating passage; and a developing roller provided at a position of facing the image bearing member, wherein:

the circulating passage includes a front conveyance passage extending along the developing roller, and a rear conveyance passage extending parallel to the front conveyance passage and passing a position to receive developer particles from the developer inlet section, the conveyance mechanism includes a front conveyer and a rear conveyer which are rotatable about their respective axes to convey developer particles in specified conveyance directions, the front conveyer being provided in the front conveyance passage and the rear conveyer being provided in the rear conveyance passage, the rear conveyer having a conveyance power reduction portion for reducing the conveyance power locally, and the developer inlet section includes a first developer inlet opening for allowing developer particles from the developer supplier to come in, and a second developer inlet opening for allowing developer particles recovered from the image bearing member to come in, the first and second developer inlet openings being provided in the circulating passage at locations which are on upstream of the conveyance power reduction portion of the rear conveyer and where developer particles coming from the first developer inlet opening and/or the second developer inlet opening are likely to be upwardly surged due to the rotation of the rear conveyer.

2. A developing device according to claim 1, wherein the second developer inlet opening is provided in a location which satisfies the following equation:

$$l \leqq \frac{2}{5} \times L$$

wherein l denotes a distance between an upstream end of the rear conveyer in a conveyance direction and a downstream end of the second developer inlet opening, and L denotes a length of the rear conveyer.

3. A developing device according to claim 1, wherein the second developer inlet opening is provided on upstream of the first developer inlet opening in the circulating passage.

4. A developing device according to claim 1, wherein the developer particles include carrier particles and toner particles.

5. A developing device according to claim 1, wherein each of the front conveyer and the rear conveyer includes a spiral feeder having a feeder shaft and a spiral fin spirally formed on a periphery of the feeder shaft for conveying developer particles in a predetermined conveyance direction in accordance with an integral rotation of the spiral fin and the feeder shaft.

6. A developing device according to claim 5, wherein the spiral fin of the rear conveyer has a clockwise spiral direction.

7. An image forming apparatus comprising:

a developing device including a conveyance mechanism for conveying a developer; and a driving mechanism for driving the conveyance mechanism, wherein the developing device includes:

a housing;

a circulating passage for conveying developer particles while stirring them, the circulating passage being provided in the housing;

a developer supplier for supplying developer particles in the housing;

a developer inlet section for allowing developer particles to come in from the developer supplier, the developer inlet section being formed in an upper portion of the housing;

a conveyance mechanism for conveying developer particles received through the developer inlet section, the conveyance mechanism being provided in the circulating passage; and a developing roller provided at a position facing an image bearing member, wherein:

the circulating passage includes a front conveyance passage extending along the developing roller, and a rear conveyance passage extending parallel to the front conveyance passage and passing a position to receive developer particles from the developer inlet section, the conveyance mechanism includes a front conveyer and a rear conveyer which are rotatable about their respective axes to convey developer particles in specified conveyance directions, the front conveyer being provided in the front conveyance passage and the rear conveyer being provided in the rear conveyance passage, the rear conveyer having a conveyance power reduction portion for reducing the conveyance power locally, and the developer inlet section includes a first developer inlet opening for allowing developer particles from the developer supplier to come in, and a second developer inlet opening for allowing developer particles recovered from the image bearing member to come in, the first and second developer inlet openings being provided in the circulating passage at locations which are on upstream of the conveyance power reduction portion of the rear conveyer and where developer particles coming from the first developer inlet opening and/or the second developer inlet opening are likely to be upwardly surged due to the rotation of the rear conveyer.

8. An image forming apparatus according to claim 7, wherein the second developer inlet opening is provided in a location which satisfies the following equation:

$$l \leqq \frac{2}{5} \times L$$

wherein l denotes a distance between an upstream end of the rear conveyer in a conveyance direction and a downstream end of the second developer inlet opening, and L denotes a length of the rear conveyer.

9. An image forming apparatus according to claim 7, wherein the second developer inlet opening is provided on upstream of the first developer inlet opening in the circulating passage.

10. An image forming apparatus according to claim 7, wherein the developer particles include carrier particles and toner particles.

11. An image forming apparatus according to claim 7, wherein each of the front conveyer and the rear conveyer includes a spiral feeder having a feeder shaft and a spiral fin spirally formed on a periphery of the feeder shaft for conveying developer particles in a predetermined conveyance direction in accordance with an integral rotation of the spiral fin and the feeder shaft.

12. An image forming apparatus according to claim 11, wherein the spiral fin of the rear conveyer has a clockwise spiral direction.

* * * * *